US009232878B2

(12) United States Patent
Seo

(10) Patent No.: US 9,232,878 B2
(45) Date of Patent: Jan. 12, 2016

(54) UPRIGHT TYPE VACUUM CLEANER

(75) Inventor: Jinwook Seo, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 448 days.

(21) Appl. No.: 13/348,789

(22) Filed: Jan. 12, 2012

(65) Prior Publication Data

US 2012/0180258 A1 Jul. 19, 2012

(30) Foreign Application Priority Data

Jan. 18, 2011 (KR) ..... 10-2011-004882

(51) Int. Cl.
*A47L 5/28* (2006.01)
*A47L 9/00* (2006.01)

(52) U.S. Cl.
CPC ..... *A47L 5/28* (2013.01); *A47L 9/0009* (2013.01); *A47L 9/0054* (2013.01)

(58) Field of Classification Search
CPC ..... A47L 5/25; A47L 5/30; A47L 9/1427; A47L 9/242; A47L 5/34; A47L 5/28; A47L 9/009; A47L 9/0054
USPC ..... 15/323, 351, 352, 353, 354, 339, 390, 15/414
See application file for complete search history.

(56) References Cited

U.S. PATENT DOCUMENTS

| | | | | |
|---|---|---|---|---|
| 1,689,166 | A * | 10/1928 | Varner | 15/98 |
| 6,006,401 | A * | 12/1999 | Jailor et al. | 15/361 |
| 2008/0115313 | A1 * | 5/2008 | Dyson et al. | 15/336 |
| 2010/0236015 | A1 * | 9/2010 | Worker et al. | 15/347 |
| 2011/0088202 | A1 * | 4/2011 | McLuckie et al. | 15/329 |

FOREIGN PATENT DOCUMENTS

KR 10-2007-0100895 A 10/2007

* cited by examiner

*Primary Examiner* — Robert Scruggs
(74) *Attorney, Agent, or Firm* — Ked & Associates, LLP

(57) ABSTRACT

The present invention relates to an upright type vacuum cleaner including a body having a changeable angle of disposition with respect to an objective surface to be cleaned, a suction nozzle coupled to the body to be movable along the objective surface to be cleaned, a supporting assembly provided under the body to seat the body thereon for supporting a load of the body and guiding movement of the body with respect to the objective surface to be cleaned, and a holding unit rotatably provided to the supporting assembly so as to be brought into contact with the body selectively for limiting rotation of the body to hold the body.

17 Claims, 11 Drawing Sheets

UPRIGHT TYPE VACUUM CLEANER

CROSS REFERENCE TO RELATED APPLICATION

This application claims the benefit of the Patent Korean Application No. 10-2011-0004882, filed on Jan. 18, 2011, which is hereby incorporated by reference as if fully set forth herein.

BACKGROUND OF THE DISCLOSURE

1. Field of the Disclosure

The present invention relates to upright type vacuum cleaners, and more particularly to an upright type vacuum cleaner which enables to maintain an angle of disposition of a body of the upright type vacuum cleaner with respect to an objective surface to be cleaned if the angle is changed.

2. Discussion of the Related Art

In general, the vacuum cleaner is a domestic appliance for sucking up dust and foreign matter from the objective surface to be cleaned together with air by suction force of a suction motor in the body and filtering the dust and the foreign matter within the body.

In the vacuum cleaners having above function, there are an upright type vacuum cleaner having a suction nozzle and the body integrated as one body, and a canister type vacuum cleaner having the suction nozzle and the body connected with a connection pipe.

Of the two kinds of vacuum cleaners, the upright type vacuum cleaner is provided with a vacuum cleaner body having the suction motor built therein for generating the suction force, a suction nozzle for sucking up the dust and foreign matter from the objective surface to be cleaned by the suction force generated by the suction motor, a handle above the body of the vacuum cleaner for a user to hold and move the upright type vacuum cleaner along the objective surface to be cleaned.

The upright type vacuum cleaner has the body mounted above the suction nozzle to be rotatable with respect to the objective surface to be cleaned, such that the user performs cleaning while changing the angle of disposition of the body with respect to the objective surface to be cleaned, and stores the upright type vacuum cleaner after finishing the cleaning, leaving the angle of disposition of the body with respect to the objective surface to be cleaned to set at a fixed angle.

However, since the body is rotatably mounted above the suction nozzle, there has been a problem in that the body rotates and falls down onto the objective surface to be cleaned during storage of the body.

Consequently, a requirement for a supporting structure which maintains a fixed angle of disposition with respect to the objective surface to be cleaned by limiting rotation of the body is brought up.

SUMMARY OF THE DISCLOSURE

Accordingly, the present invention is directed to an upright type vacuum cleaner.

An object of the present invention is to provide an upright type vacuum cleaner in which a supporting portion is provided for supporting a body of the vacuum cleaner to maintain a fixed angle of disposition of the body with respect to an objective surface to be cleaned.

Another object of the present invention is to provide an upright type vacuum cleaner in which a supporting unit is provided for supporting a body of the vacuum cleaner that supports the body to maintain at a predetermined tilted angle with respect to the objective surface to be cleaned at the time of cleaning the objective surface to be cleaned for making cleaning much more convenient than before.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an upright type vacuum cleaner includes a body having a changeable angle of disposition with respect to an objective surface to be cleaned, a suction nozzle coupled to the body to be movable along the objective surface to be cleaned, a supporting assembly provided under the body to seat the body thereon for supporting a load of the body and guiding movement of the body with respect to the objective surface to be cleaned, and a holding unit rotatably provided to the supporting assembly so as to be brought into contact with the body selectively for limiting rotation of the body to hold the body.

In another aspect of the present invention, an upright type vacuum cleaner includes a body rotatably provided with respect to an objective surface to be cleaned, a suction nozzle coupled to the body to be movable along the objective surface to be cleaned, a supporting assembly provided under the body to seat the body thereon for supporting a load of the body and guiding movement of the body with respect to the objective surface to be cleaned, a holding unit rotatably provided to the supporting assembly so as to be brought into contact with the body when the body is in an upright position for holding the body not to rotate, and a supporting unit rotatably provided to a rear of the body to support the body in a tilted state of the body with respect to the objective surface to be cleaned.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts. In this course, sizes and shapes of elements shown in drawings may be exaggerated in view of clarity and convenience of description. And, words defined specially taking a configuration and operation of the present invention into account may vary with intention or usual practice of users, and operators. Definitions of those words are required to be made based on overall description of the specification.

And, aspects of the present invention are not limited to the embodiments suggested herein, but, though persons who understand the aspects of the present invention may embody other embodiments easily, it is evident that the embodiments also belong to the scope of the present invention.

Figure 1:
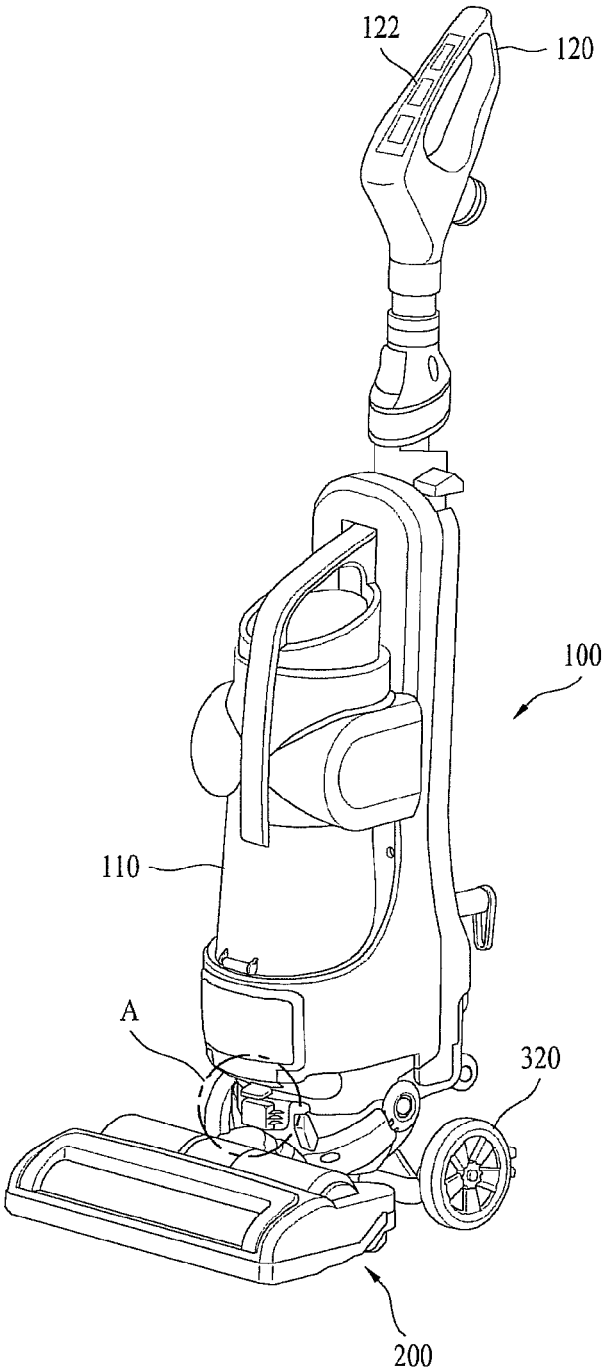
FIG. 1 illustrates a front perspective view of an upright type vacuum cleaner in accordance with a preferred embodiment of the present invention.

FIG. 1 illustrates a front perspective view of an upright type vacuum cleaner in accordance with a preferred embodiment of the present invention. A configuration and operation of an upright type vacuum cleaner in accordance with a preferred embodiment of the present invention will be described in detail, with reference to FIG. 1.

Referring to FIG. 1, the upright type vacuum cleaner includes a body 100 having a dust collecting bag 110 mounted thereto for collecting dust and foreign matter from an objective surface to be cleaned, a suction nozzle 200 below the body 100 for sucking up the dust and foreign matter from the objective surface to be cleaned together with air, and a handle 120 above the body 100 for a user to hold in moving the body 100 at the time of cleaning.

The body 100 is arranged above, and rotatably coupled to, the suction nozzle 200.

Therefore, the body 100 is provided to vary an angle of disposition with respect to the objective surface to be cleaned, enabling the user to perform cleaning in a state the user turns the body 100 toward the objective surface to be cleaned.

The body 100 has the dust collecting bag 110 detachably mounted to a front of the body 100. The dust collecting bag 110 has a dust separation member (Not shown) provided thereto for filtering the dust and foreign matter from the air drawn in the body 100 by a cyclone principle.

That is, the air introduced to the body 100 through the suction nozzle 200 is introduced to the dust collecting bag 110, and the dust and foreign matter in the air introduced to the dust collecting bag 110 is filtered by the dust separation member and collected in the dust collecting bag 110.

And, the clean air having the dust and foreign matter removed therefrom is discharged to an outside of the body 100.

And, since the dust collecting bag 110 is detachably mounted to the body 100, if the user intends to throw away the dust and foreign matter collected thus in the dust collecting bag 110, the user can dispose the dust and foreign matter readily by detaching the dust collecting bag 110 from the body 100.

In the meantime, though FIG. 1 illustrates a cylindrical dust collecting bag 110, the dust collecting bag 110 may have a polygonal column shape, such as a square column, and the shape of the dust collecting bag 110 does not confine the present invention.

The suction nozzle 200 is provided below the body 100 to move along the objective surface to be cleaned for sucking up the dust and foreign matter from the objective surface to be cleaned together with the air.

That is, the suction nozzle 200 has a suction opening (Not shown) in a shape of a slot opened in a length direction of the suction nozzle 200 in an underside of the suction nozzle 200.

As the suction force the suction motor (Not shown) in the body 100 generates is transmitted to the suction opening, the dust and foreign matter is sucked up from the objective surface to be cleaned to the body 100.

In the meantime, the body 100 has one pair of wheels 320 rotatably provided to both sides of an underside of the body 100.

That is, if the user performs cleaning, the suction nozzle 200 is moved in front/rear and left/right directions on the objective surface to be cleaned for sucking up the dust and foreign matter from the objective surface to be cleaned, when the wheels 320 rotate such that the suction nozzle 200 moves smoothly on the objective surface to be cleaned.

In the meantime, the handle 120 is provided above the body 100. Therefore, during cleaning, the user may hold the handle 120 to hold the body 100 such that the body 100 is maintained in a state in which the body 100 is rotated to a predetermined angle.

And, there is an operation panel 122 on the handle 120 for controlling an operation state of the upright type vacuum cleaner of the present invention by pressing a button on the operation panel 122.

For an example, by controlling suction strength and a cleaning time period of the suction nozzle 200 according to a state of the objective surface to be cleaned, convenience of the user may be improved.

Figure 2:
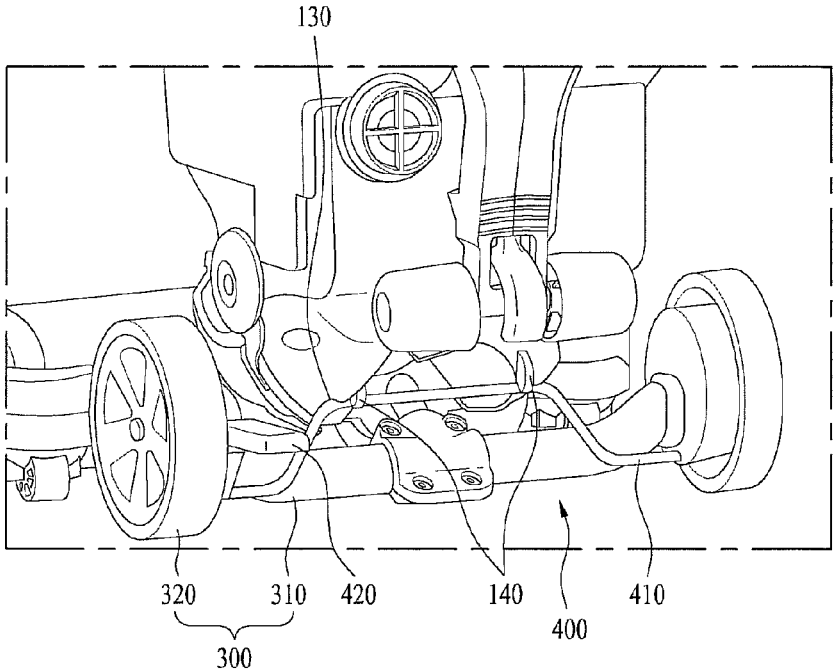
FIG. 2 illustrates a back side perspective view of an upright type vacuum cleaner in accordance with a preferred embodiment of the present invention.

FIG. 2 illustrates a back side perspective view of an upright type vacuum cleaner in accordance with a preferred embodiment of the present invention. A configuration and operation of the upright type vacuum cleaner in accordance with a preferred embodiment of the present invention will be described in detail, with reference to FIG. 2.

Description of elements identical to description with reference to FIG. 1 will be omitted.

Provided under the body 100, there is a supporting assembly 300 for supporting a load of the body 100.

The supporting assembly 300 includes a supporting shaft 310 for seating the body 100 thereon to support the load of the body 100, and the wheels 320 rotatably provided to both ends of the supporting shaft 310 for guiding movement of the body 100 with respect to the objective surface to be cleaned.

And, the supporting assembly 300 has a holding unit provided thereto for holding rotation of the body 100 to hold the body 100 at a position, wherein the holding unit is rotatably provided to the supporting assembly 300 for being brought into contact with the body 100, selectively.

The upright type vacuum cleaner of the present invention is stored in an upright position. By providing the holding unit 400 to the body 100, the body 100 can maintain the upright position.

The holding unit 400 includes a holding frame 410 for holding the body 100, a lever 420 rotatably provided to one side of the holding frame 410, and an elastic member 430 (Not shown, See FIG. 4) for providing elastic force to one end of the lever 420.

The holding frame 410 is brought into contact with the body 100, and placed in at least one holding slot 130 in an underside of the body 100 to hold the body 100.

That is, the holding frame 410 is placed in the holding slot 130 formed in the underside of the body 100 for limiting rotation of the body 100.

In the meantime, a holding projection 140 is provided adjacent to the holding slot 130 for preventing the holding frame 410 from moving off the holding slot 130.

In the meantime, the lever 420, rotatably provided to one side of the holding frame 410, is mounted to link with the rotation of the lever 420.

Therefore, depending on user's pressing down on the lever 420, the lever 420 makes the holding frame 410 to rotate, selectively.

That is, if the user steps on the lever 420, the holding frame 410 may move off the holding slot 130.

In the meantime, if the user steps on the lever 420 again, the holding frame 410 moved off the holding groove 130 thus may be placed in the holding groove 130. This will be described in detail, later.

Figure 3:
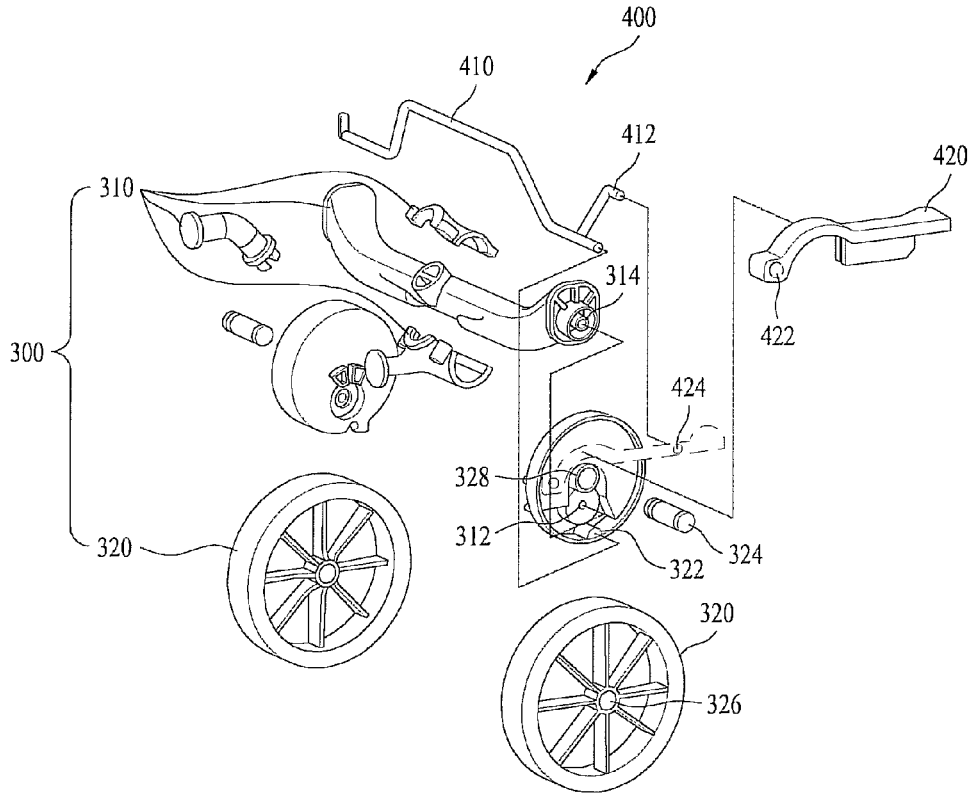
FIG. 3 illustrates an exploded perspective view of a supporting assembly and a holding unit of an upright type vacuum cleaner in accordance with a preferred embodiment of the present invention.

FIG. 3 illustrates an exploded perspective view of a supporting assembly and a holding unit of an upright type vacuum cleaner in accordance with a preferred embodiment of the present invention.

The supporting assembly 300 and coupling of the supporting assembly 300 to the holding unit will be described in detail, with reference to FIG. 3.

As described before, the supporting assembly 300 is provided under the body 100 for supporting the load of the body 100.

The supporting assembly 300 includes a supporting shaft 310 for seating the body 100 thereto to support the load of the body 100, and wheels 320 rotatably provided to both ends of the supporting shaft 310 for guiding movement of the body 100 with respect to the objective surface to be cleaned.

Referring to FIG. 3, the wheels 320 are plural, and as a coupling member 324 is placed in a first wheel hole 326 and a second wheel hole 328, the plurality of wheels 320 are connected.

And, the supporting shaft 310 has shaft projections 314 from both ends of the supporting shaft 310, wherein, as the shaft projection 314 is placed in a shaft hole 312 in the wheel 320, the supporting shaft 310 is coupled to the wheel 320.

In the meantime, as both ends of the holding frame 410 rotatably provided to the supporting assembly 300 are respectively placed in frame holes 322 in the wheels 320, the supporting assembly 300 is coupled to the holding frame 410.

Therefore, the holding frame 410 has a portion bent upward toward the body 100 for holding the body 100.

And, the holding frame 410 has one end with a linkage portion 412 which is a predetermined length of extension from the end in a radial direction for rotating the holding frame 410 linked with the rotation of the lever 420.

The operation of the lever 420 and the holding frame 410 will be described, in detail.

The lever 420 is provided to one side of the holding frame 410 for the user to press down to rotate the lever 420, selectively.

The lever 420 has a fastening hole 422 formed in one end thereof.

As a fastening projection 432 on the wheel 320 is placed in the fastening hole 422, the lever 420 is connected to the wheel 320.

The lever 420 has a connection hole 424 in the other end. As one end of the linkage portion 412 is placed in the connection hole 424, the holding frame 410 is connected to the lever 420.

Therefore, the linkage portion 412 can rotate the holding frame 410 linked with the rotation of the lever 420.

FIGS. 4 to 9 illustrate longitudinal sections showing the steps of operation of a holding unit of an upright type vacuum cleaner in accordance with a preferred embodiment of the present invention, schematically. The steps of operation of the body 100 and the holding unit will be described with reference to FIGS. 4 to 9, in detail.

When the upright type vacuum cleaner of the present invention is in storage, the body 100 is upright with respect to the objective surface to be cleaned.

Figure 4:
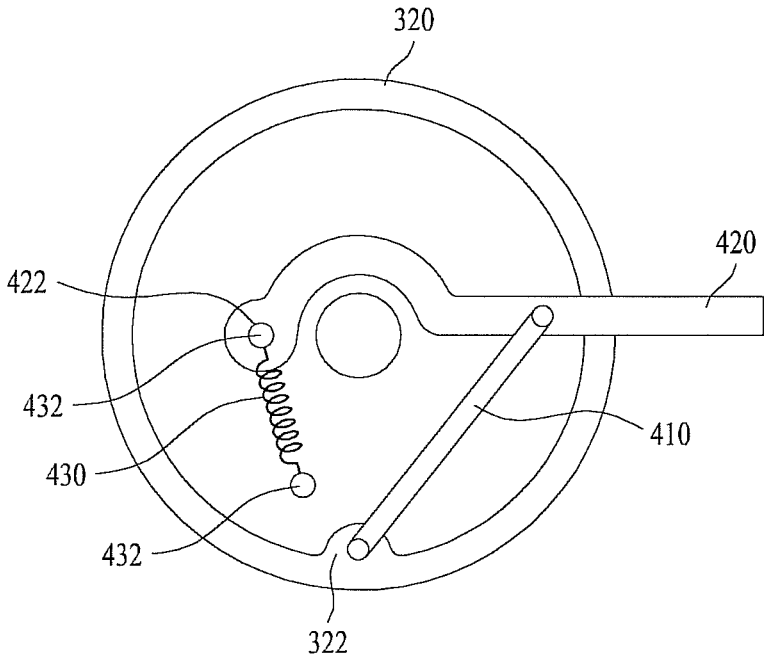
FIGS. 4 to 9 illustrate longitudinal sections showing the steps of operation of a holding unit of an upright type vacuum cleaner in accordance with a preferred embodiment of the present invention, schematically.

In this case, referring to FIG. 4, the holding frame 410 is connected to the lever 420, and, as the fastening projection 432 is placed in the fastening hole 422 in one end of the lever 420, the lever 420 is coupled to the wheel 320.

And, there is an elastic member 430 between the fastening projections 432 with both ends thereof coupled to the fastening projections 432.

Figure 5:
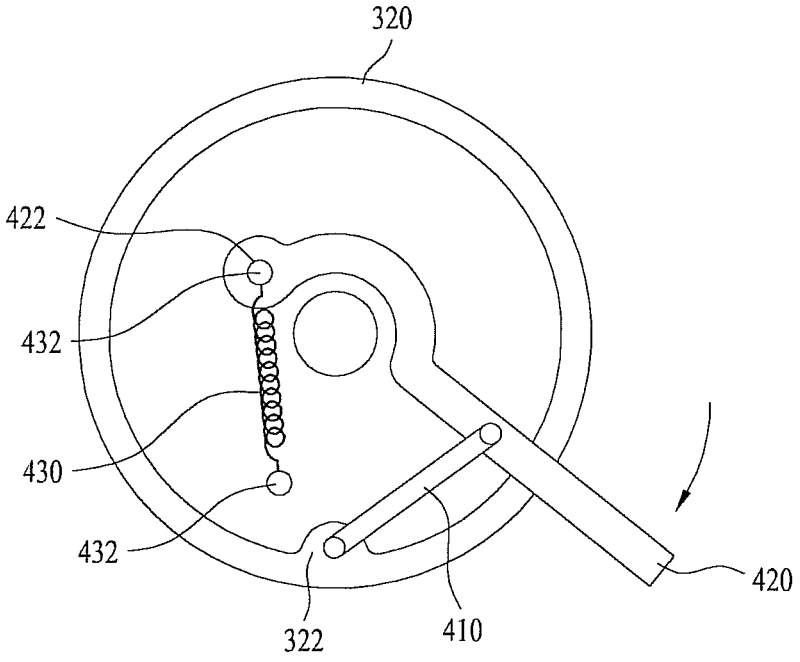

In the meantime, referring to FIG. 5, as the holding frame 410 is placed in a holding slot 130 in an underside of the body 100 to hold the body 100, the body 100 maintains the upright position with respect to the objective surface to be cleaned.

Figure 6:
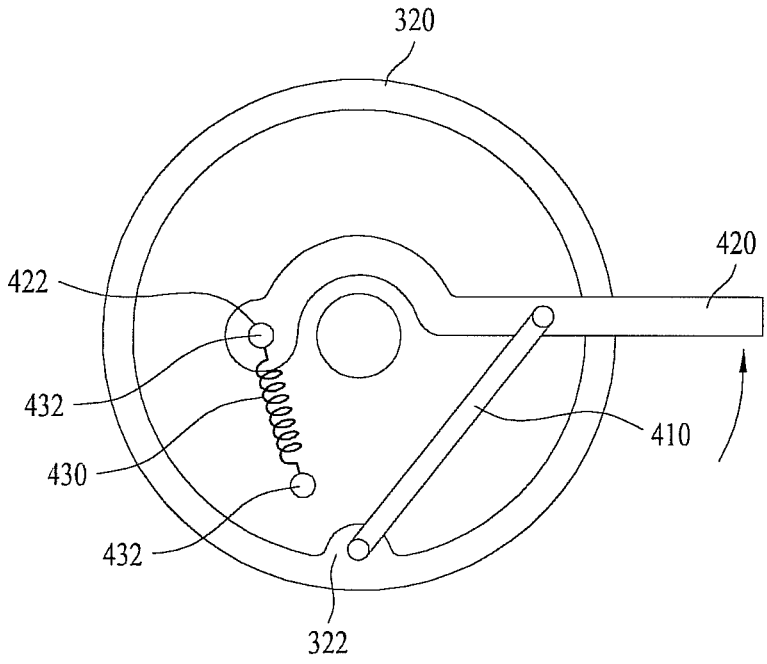

And, referring to FIG. 6, when the user presses down the other end of the lever 420, the holding frame 410 also rotates to one side, extending the elastic member 430 having one end coupled to the lever 420.

Figure 7:
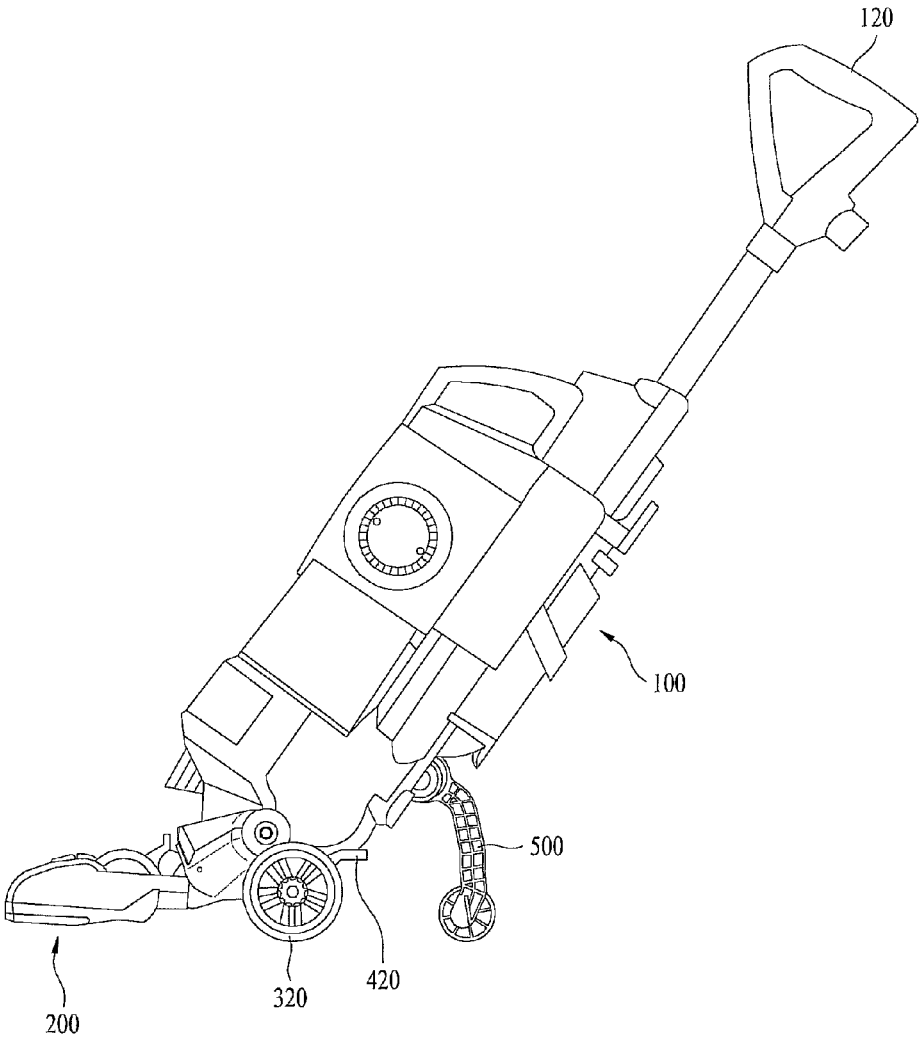

In this case, referring to FIG. 7, as the holding frame 410 rotates to one side, the holding frame 410 moves off the holding slot 130.

Figure 8:
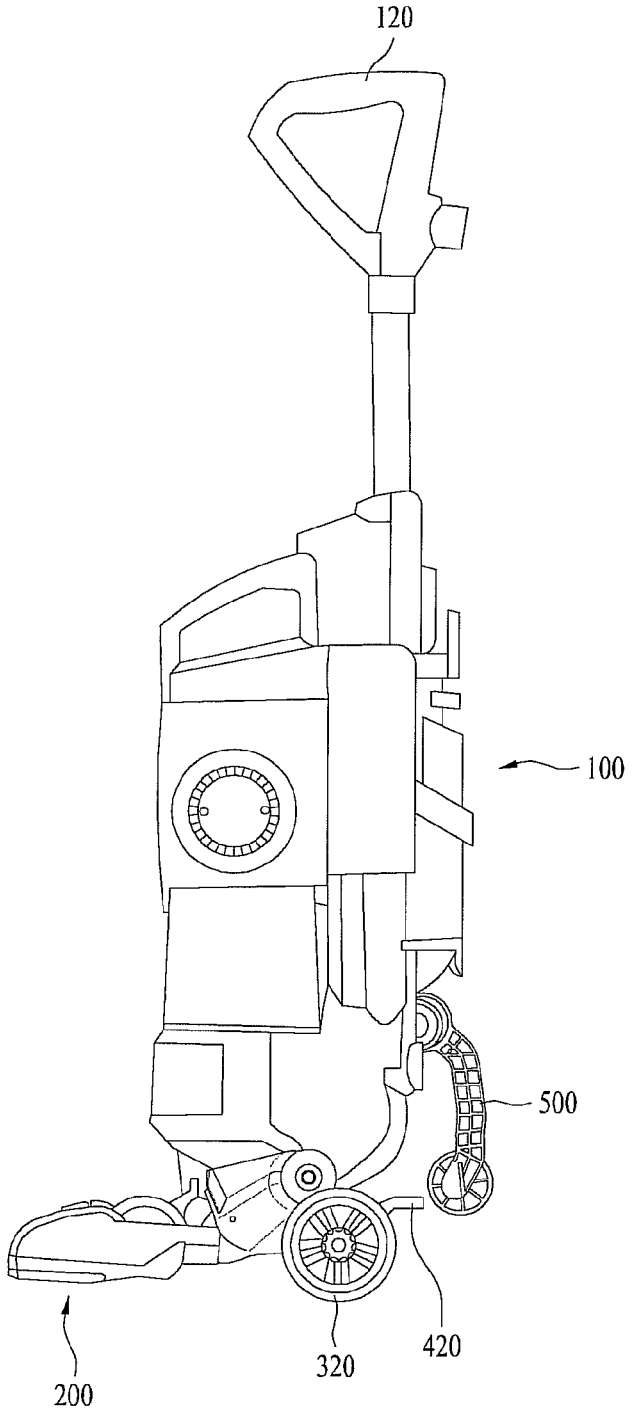

And, referring to FIG. 8, if the user releases the pressing down on the lever 420, the lever 420 rotates to the other side by elastic force of the elastic member 430.

Figure 9:
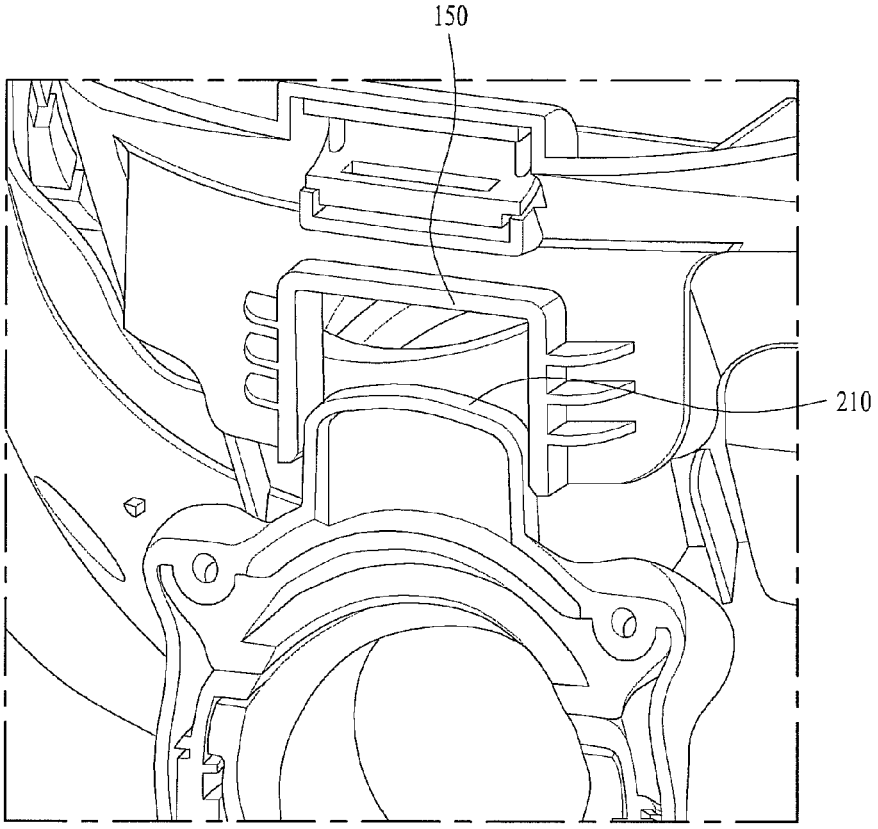

In this case, referring to FIG. 9, as the body 100 moves toward the objective surface to be cleaned, the user can perform cleaning while changing the angle of disposition of the body 100 with respect to the objective surface to be cleaned.

In the meantime, after the user finishes the cleaning, by performing above steps of operation in a reverse direction, the upright position of the body 100 may be made to be maintained.

That is, after pressing down the lever 420 to rotate the lever 420 to one side for maintaining the body 100 in the upright position, upon releasing the pressing down on the lever 420, both the lever 420 and the holding frame 410 rotate to the other side by the elastic force of the elastic member 430.

And, as the holding frame 410 rotating to the other side is placed in the holding slot 130, the body 100 maintains the upright position with respect to the objective surface to be cleaned.

Figure 10:
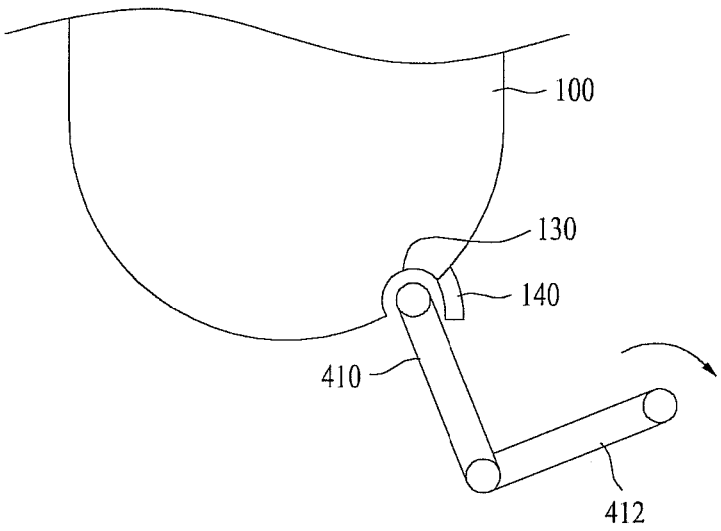
FIGS. 10 and 11 illustrate side views showing the steps of operation of a body of an upright type vacuum cleaner in accordance with a preferred embodiment of the present invention.
Figure 11:
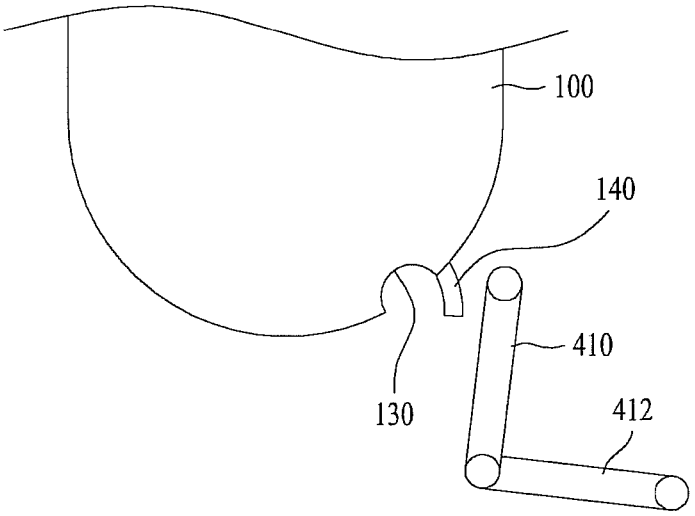

FIGS. 10 and 11 illustrate side views showing the steps of operation of a body 100 of an upright type vacuum cleaner in accordance with a preferred embodiment of the present invention.

Referring to FIG. 10, the angle of disposition of the body 100 with respect to the objective surface to be cleaned changes, and the user holds the handle 120 above the body 100 and performs cleaning.

When the user cleans by using the vacuum cleaner, the body is in a tilted state with respect to the objective surface to be cleaned within a predetermined range of angles.

In this instance, in order to reduce a load of weight of the body 100, the vacuum cleaner of the present invention further includes a supporting unit 500 rotatably provided to a rear of the body 100 for supporting the body 100 in a tilted state of the body 100 with respect to the objective surface to be cleaned.

It is preferable that the supporting unit 500 is mounted to the rear of the body 100 to be rotatable in front/rear directions.

This is because it is necessary to change an angle of tilt of the cleaner body with respect to the objective surface to be cleaned depending on situations at the time of cleaning.

And, since it is required that the supporting unit 500 supports the body 100 to maintain a tilted state with respect to the objective surface to be cleaned by a predetermined angle, it is preferable that the supporting unit 500 is secured at a predetermined fixed angle from the body.

Accordingly, in the cleaning, the user may perform the cleaning while moving the body 100 only in a horizontal direction even without lifting the vacuum cleaner and maintaining the tilted state of the body 100 with respect to the objective surface to be cleaned by a predetermined angle.

Referring to FIG. 11, after finishing the cleaning, the user puts the body 100 upright to store the upright type vacuum cleaner.

As described before, after the user presses down the lever 420 to rotate the lever 420 to one side to maintain the body 100 in the upright position, if the user releases the pressing down on the lever 420, the holding frame 410 rotates in a direction in which the holding frame 410 holds the body 100 to maintain the upright position of the body 100.

Eventually, storage of the upright type vacuum cleaner of the present invention becomes easy.

Figure 12:
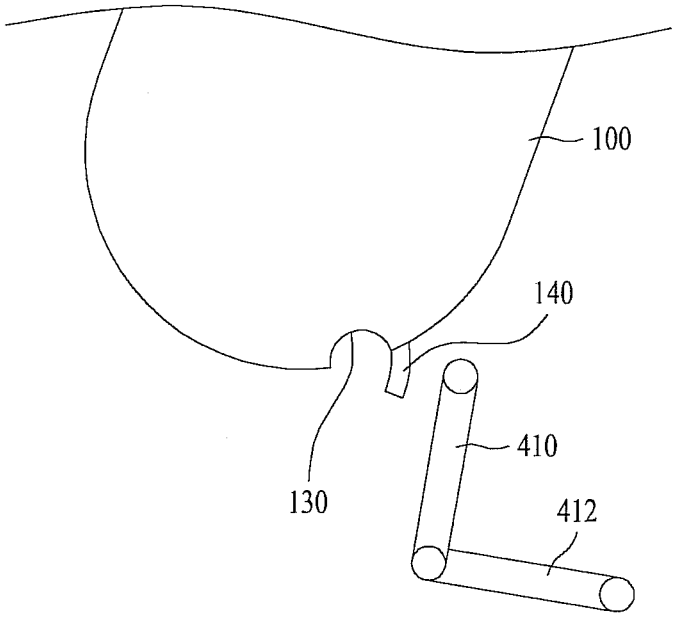
FIG. 12 illustrates a perspective view showing coupling of a suction nozzle to a body of an upright type vacuum cleaner in accordance with a preferred embodiment of the present invention.

FIG. 12 illustrates a perspective view showing coupling of a suction nozzle 200 to a body 100 of an upright type vacuum cleaner in accordance with a preferred embodiment of the present invention.

Referring to FIG. 12, the body 100 has a fastening recess 150 at a lower side of a front thereof, and the suction nozzle 200 has a limiting projection 210 to be placed in the fastening recess 150.

The limiting projection 210 is placed in the fastening recess 150 provided to the lower side of the body 100 to support the body 100 which is maintaining a predetermined angle of disposition with respect to the objective surface to be cleaned.

The body 100 rotates relative to the suction nozzle 200. When the body 100 rotates forward, the limiting projection 210 is brought into contact with an inside surface of an upper side of the fastening recess 150 to support the body 100. Particularly, at the time the body 100 is in the upright position as shown in FIG. 11, the limiting projection 210 limits the body 100 not to rotate forward more than a predetermined angle from the upright position.

Therefore, at the time of storage of the cleaner, the upright position of the body 100 may be secured more firmly.

The vacuum cleaner of the present invention permits to maintain the upright position of the body owing to the holding unit at the time of storage, to limit a forward direction rotation angle of the body owing to the limiting projection 210, and to maintain a tilting angle of the body with respect to the objective surface to be cleaned during cleaning owing to the supporting unit.

Therefore, the user can use the vacuum cleaner conveniently in states in which the angle of the body is changed or maintained at a predetermined angle according to cases of cleaning or storage of the vacuum cleaner.

As has been described, the upright type vacuum cleaner of the present invention has the following advantages.

The holding unit under the body of the vacuum cleaner limits rotation of the body to hold the body.

Therefore, if the user rotates the body to tilt the body with respect to the objective surface to be cleaned by a predetermined angle, the angle of tilt is maintained continuously such that a load of the body is placed on the holding unit substantially to reduce physical load the user who holds the handle of the body feels as much.

In the meantime, if it is intended to return the tilted body to the upright position, by pressing down the lever and rotating the body in the pressed down state, the body can be returned to the upright position, easily.

Eventually, if the user store the body of the vacuum cleaner in the upright position after finishing the cleaning, a position change of the body for the storage can be made, easily.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An upright type vacuum cleaner, comprising:

a body having a changeable angle of disposition with respect to a target surface to be cleaned;

a suction nozzle rotatably coupled to the body to be movable along the target surface to be cleaned for cleaning the target surface;

a supporting assembly provided under the body for seating the body thereon that supports a load of the body and guides movement of the body with respect to the target surface to be cleaned when the suction nozzle moves along the target surface and cleans the target surface, wherein the supporting assembly supports the load of the body (a) when the body is in a tilted position with respect to the target surface to be cleaned and the suction nozzle moves along the target surface and cleans the target surface, and (b) when the body is in an upright position for storing the cleaner; and a holding unit rotatably coupled to the supporting assembly, wherein the holding unit is configured to be brought into contact with the body to maintain the upright position and to hold the body in position against the supporting assembly, wherein the supporting assembly includes:

a supporting shaft for seating the body thereon that supports the load of the body; and a pair of wheels respectively provided at two opposite ends of the supporting shaft for guiding movement of the body with respect to the target surface to be cleaned.

2. The upright type vacuum cleaner as claimed in claim 1, wherein the holding unit comprises:

a holding frame to be brought into contact with the body for holding the body, and a lever rotatably coupled to a first end of the holding frame and configured to selectively rotate the holding frame in response to a downward force applied to the lever.

3. The upright type vacuum cleaner as claimed in claim 2, wherein the holding frame includes a linkage portion comprising an extension having a predetermined length and extending in a radial direction from an outer circumferential surface of the first end of the holding frame, wherein the linkage portion is connected to the lever such that the holding frame rotates together with the rotation of the lever.

4. The upright type vacuum cleaner as claimed in claim 2, wherein the first end and a second end of the holding frame are each rotatably coupled to the supporting assembly, with an intermediate portion of the holding frame between the first and second ends being bent upward toward the body.

5. The upright type vacuum cleaner as claimed in claim 2, wherein the body has at least one holding slot formed in an underside thereof, and the holding frame is selectively received in the holding slot for holding the body in position.

6. The upright type vacuum cleaner as claimed in claim 5, wherein the body has a holding projection adjacent to the holding slot for preventing the holding frame from being released from the holding slot.

7. The upright type vacuum cleaner as claimed in claim 2, wherein the holding unit further comprises an elastic member provided between the supporting assembly and the lever for providing an elastic force to the lever to restore a position of the rotated lever to an initial position.

8. The upright type vacuum cleaner as claimed in claim 1, wherein the suction nozzle includes a limiting projection configured to be received in a fastening recess formed in a lower side of the body so as to support the body at a predetermined angle of disposition with respect to the target surface to be cleaned.

9. The upright type vacuum cleaner as claimed in claim 1, further comprising a supporting unit rotatably coupled to the body to support the body on the target surface to be cleaned.

10. An upright type vacuum cleaner, comprising:

a body rotatably provided with respect to a target surface to be cleaned;

a suction nozzle configured to be movable along a target surface to be cleaned and rotatably coupled to the body;

a supporting assembly provided under the body for seating the body thereon that supports a load of the body and guides movement of the body with respect to the target surface to be cleaned when the suction nozzle moves along the target surface and cleans the target surface, wherein the supporting assembly supports the load of the body (a) when the body is in a tilted position with respect to the target surface to be cleaned and the suction nozzle moves along the target surface and cleans the target surface, and (b) when the body is in an upright position for storing the cleaner;

a holding unit rotatably coupled to the supporting assembly, wherein the holding unit is configured to be brought into contact with the body when the body is in an upright position so as to restrict rotation of the body; and a supporting unit rotatably coupled to a rear of the body to support the body in a tilted state of the body with respect to the target surface to be cleaned, wherein the supporting assembly includes:

a supporting shaft for seating the body thereon that supports the load of the body; and a pair of wheels respectively provided at two opposite ends of the supporting shaft for guiding movement of the body with respect to the target surface to be cleaned.

11. The upright type vacuum cleaner as claimed in claim 10, wherein the holding unit comprises:

a holding frame rotatably coupled to the supporting assembly and configured to be brought into contact with the body to hold the body;

a lever rotatably coupled to an end portion of the holding frame and configured to selectively rotate the holding frame in response to a downward force applied to the lever; and a linkage portion comprising an extension having a predetermined length and extending in a radial direction from an outer circumferential surface of the end portion of the holding frame, wherein the linkage portion is coupled to the lever such that the holding frame is rotated together with the lever.

12. The upright type vacuum cleaner as claimed in claim 11, wherein an intermediate portion of the holding frame is bent upward toward the body.

13. The upright type vacuum cleaner as claimed in claim 11, wherein the body includes at least one holding slot formed in an underside thereof, wherein the holding frame is selectively received in the holding slot to hold the body in the upright position.

14. The upright type vacuum cleaner as claimed in claim 13, wherein the body has a holding projection adjacent to the at least one holding slot for preventing the holding frame from being released from the at least one holding slot.

15. The upright type vacuum cleaner as claimed in claim 11, wherein the holding unit further includes an elastic member provided between the supporting assembly and the lever for providing an elastic force to the end of the lever to restore a position of the rotated lever to an initial position.

16. The upright type vacuum cleaner as claimed in claim 10, wherein the suction nozzle includes a limiting projection configured to be received in a fastening recess formed in a lower side of the body for supporting the body at a predetermined angle of disposition with respect to the target surface to be cleaned.

17. An upright type vacuum cleaner, comprising:

a body rotatably provided with respect to a target surface to be cleaned to have a changeable angle of disposition with respect to the target surface to be cleaned;

a suction nozzle configured to be movable along a target surface to be cleaned and rotatably coupled to the body;

a supporting assembly provided under the body to seat the body thereon for supporting a load of the body and guiding movement of the body with respect to the target surface to be cleaned when the suction nozzle moves along the target surface to clean the target surface, wherein the supporting assembly supports the load of the body when the body is in a tilted position with respect to the target surface to be cleaned and in an upright position of the cleaner;

a holding unit rotatably coupled to the supporting assembly, wherein the holding unit is configured to be brought into contact with the body when the body is in an upright position so as to restrict rotation of the body, wherein the supporting assembly comprises:

a supporting shaft for seating the body thereon to support the load of the body; and a pair of wheels respectively provided at two opposite ends of the supporting shaft for guiding movement of the body with respect to the target surface to be cleaned when the suction nozzle moves along the target surface to clean the target surface.

* * * * *